US007836720B2

(12) United States Patent
Cho et al.

(10) Patent No.: US 7,836,720 B2
(45) Date of Patent: Nov. 23, 2010

(54) DOOR FOR REFRIGERATOR HAVING A FIXING MEMBER FOR A WATER PIPE

(75) Inventors: Hyeon Po Cho, Changwon-si (KR); Jong Gon Kim, Changwon-si (KR); Oh Chul Kwon, Gimhae-si (KR); Bon Young Koo, Changwon-si (KR); Myung Soo Kim, Gimhae-si (KR); Yoo Min Park, Jinju-si (KR); Young Hoon Gwak, Changwon-si (KR)

(73) Assignee: LG Electronics Inc., Seoul (KR)

( * ) Notice: Subject to any disclaimer, the term of this patent is extended or adjusted under 35 U.S.C. 154(b) by 369 days.

(21) Appl. No.: 11/798,005

(22) Filed: May 9, 2007

(65) Prior Publication Data

US 2007/0261426 A1 Nov. 15, 2007

(30) Foreign Application Priority Data

May 10, 2006 (KR) ..... 10-2006-0042112

(51) Int. Cl.

| | |
|---|---|
| ***F25D 3/00*** | (2006.01) |
| ***F16L 3/00*** | (2006.01) |
| ***A47B 96/04*** | (2006.01) |

(52) U.S. Cl. ..... 62/389; 62/340; 62/344; 312/400; 312/401; 222/146.6; 248/49

(58) Field of Classification Search ..... 62/340, 62/344, 158, 167, 150, 389; 425/144, 812; 222/146.6; 264/46.6; 312/400, 401, 405; 248/49, 903; 296/155, 208

See application file for complete search history.

(56) References Cited

U.S. PATENT DOCUMENTS

| | | | | |
|---|---|---|---|---|
| 5,787,724 | A * | 8/1998 | Pohl et al. | 62/389 |
| 6,192,630 | B1 * | 2/2001 | Banicevic et al. | 49/501 |
| 7,281,391 | B2 * | 10/2007 | Marret et al. | 62/389 |
| 2004/0182104 | A1 * | 9/2004 | Choi | 62/389 |
| 2007/0074527 | A1 * | 4/2007 | Lee et al. | 62/344 |

* cited by examiner

*Primary Examiner*—Frantz F Jules
*Assistant Examiner*—Daniel C Comings
(74) *Attorney, Agent, or Firm*—Birch, Stewart, Kolasch & Birch, LLP

(57) ABSTRACT

Disclosed related to a door for a refrigerator may include an outer door forming the front exterior; a cap decoration formed at the upper and lower sides of the outer door; a water pipe drawn into the door through the cap decoration and through which water flows; and a fixing member on which a depression part fixing the water pipe is formed.

14 Claims, 3 Drawing Sheets

DOOR FOR REFRIGERATOR HAVING A FIXING MEMBER FOR A WATER PIPE

BACKGROUND OF THE INVENTION

1. Field of the Invention

The present invention relates to a door for a refrigerator and, more particularly, to a door for a refrigerator having the structure of injecting a foaming liquid into the door evenly.

2. Description of the Related Art

In general, a refrigerator is a home appliance keeping foods refrigerated or frozen for a long time as maintaining the inner temperature of the refrigerator lower than the room temperature.

In recent days, a dispenser for taking objects such as water or ice out is equipped at the front of the door covering the storage space of a refrigerator. The dispenser supplies water stored in the water tank arranged in the door or supplies ice made in the ice machine.

Doors for refrigerators of related art have some disadvantages as below.

A door for a refrigerator according to the related art has a disadvantage in that the foaming liquid is not evenly injected into the door, since the flow of the foaming liquid is shut off by a location fixing means for the water pipe installed in the door.

Further, a door for a refrigerator according to the related art has a disadvantage in that the surface of the door is dewed by the difference of the temperature between the part that an insulation layer is formed as the foaming liquid is hardened and the part that the fixing means is stuck therein.

SUMMARY OF THE INVENTION

Accordingly, the present invention is directed to a door for a refrigerator that substantially obviates one or more problems due to limitations and disadvantages of the related art.

An object of the present invention is to provide a door for a refrigerator letting the foaming liquid for forming an insulation layer to be injected into the door evenly.

Another object of the present invention is to provide a door for a refrigerator that the surface of the door is not dewed.

A door for a refrigerator according to the present invention may include an outer door forming the front exterior; a cap decoration formed at the upper part and the lower part of the outer door; a water pipe drawn into the door as passing through the cap decoration, and through which water flows; and a depression part fixing the water pipe.

A door for a refrigerator according to another aspect of the present invention may include an outer door forming the front exterior; an ice machine making ice as arranged at the rear of the outer door; a water pipe supplying water to the ice machine from the rear of the outer door; and a fixing member fixing the location of the water pipe and having a multitude of moving slits through which foaming liquid flows.

According to the door for the refrigerator according to the present invention, it is possible for foaming liquid to be injected into the door evenly.

Further, it is prevented that the surface of the door is dewed.

BRIEF DESCRIPTION OF THE DRAWINGS

Reference will now be made in detail as for the preferred embodiment of the present invention with reference to the accompanying drawings.

DETAILED DESCRIPTION OF THE INVENTION

Reference will now be made in detail to the preferred embodiments of the present invention, examples of which are illustrated in the accompanying drawings. The invention may, however, be embodied in many different forms and should not be construed as being limited to the embodiments set forth herein; rather, these embodiments are provided so that this disclosure will be thorough and complete, and will fully convey the concept of the invention to those skilled in the art.

Figure 1:
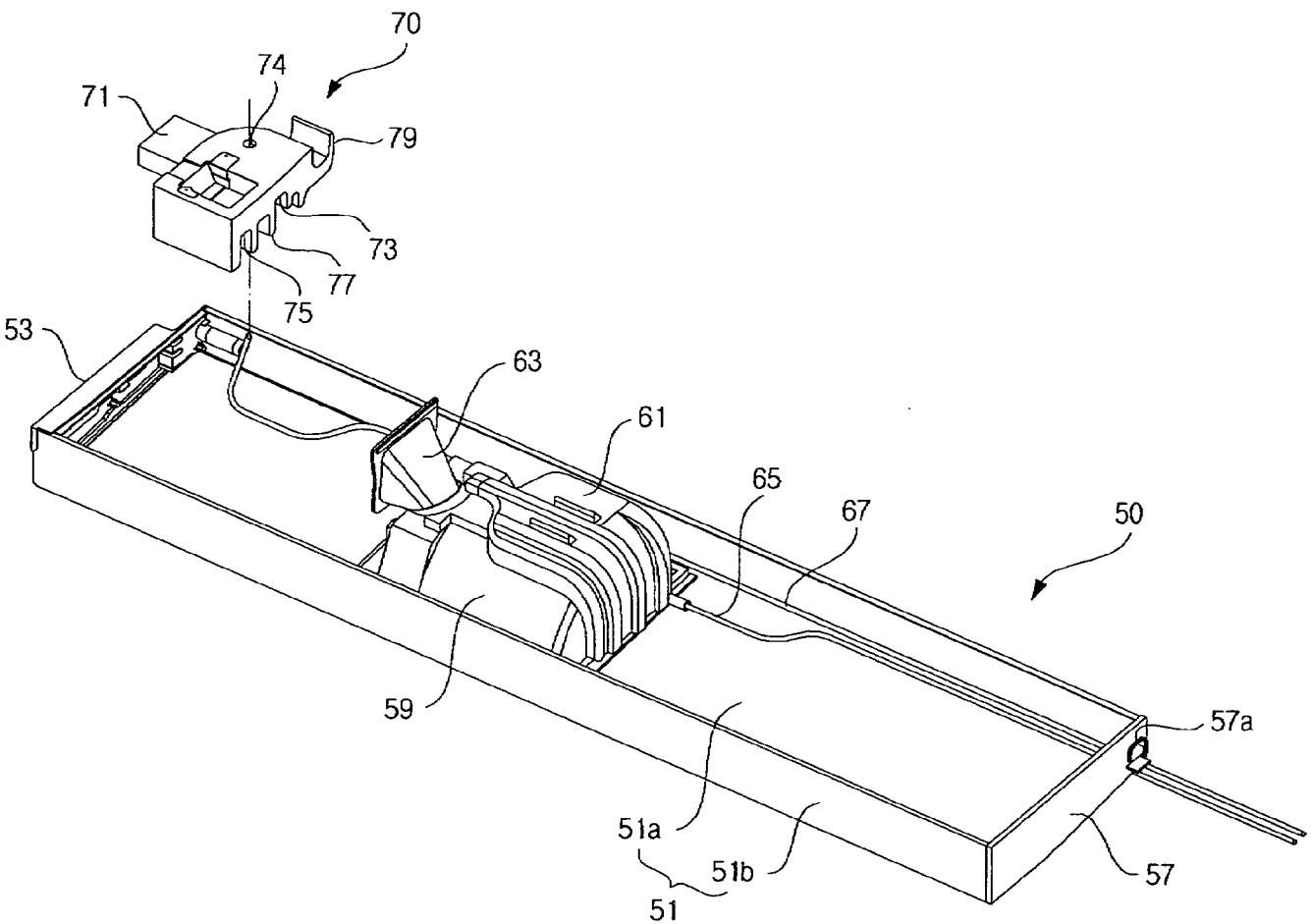
FIG. 1 is a perspective view schematically illustrating the inner structure of a door for a refrigerator according to a preferred embodiment of the present invention.
Figure 2:
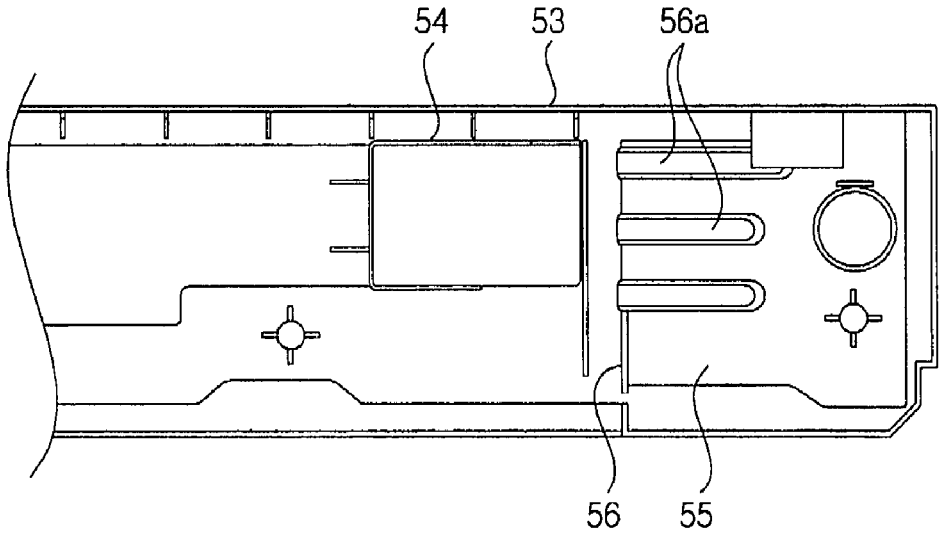
FIG. 2 is a schematic view illustrating a part of a cap decoration composing the door for a refrigerator of the present invention.
Figure 3:
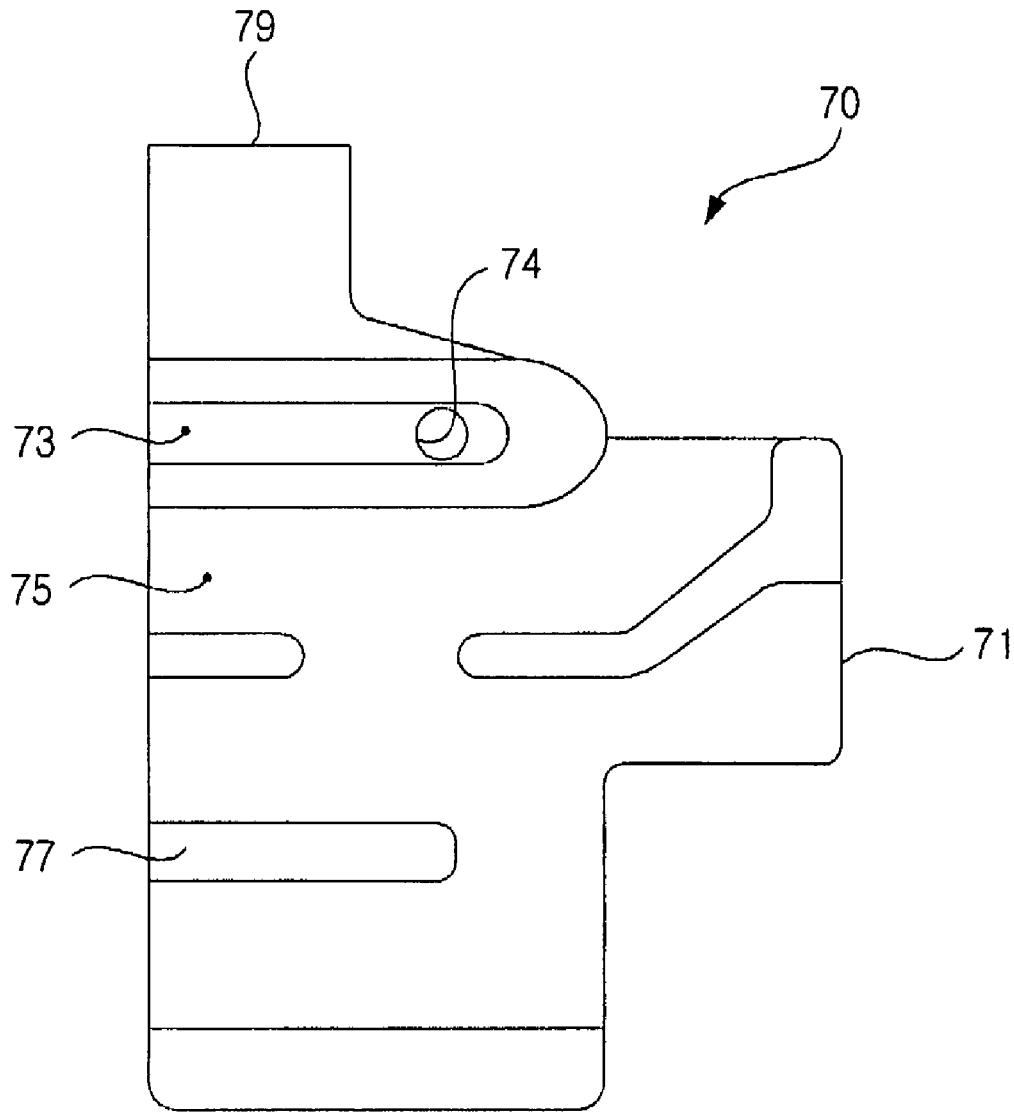
FIG. 3 is a schematic view illustrating a fixing member composing a door for a refrigerator of the present invention.

FIG. 1 is a perspective view schematically illustrating the inner structure of a door for a refrigerator according to a preferred embodiment of the present invention, FIG. 2 is a schematic view illustrating a part of a cap decoration composing the door for a refrigerator of the present invention, and FIG. 3 is a schematic view illustrating a fixing member composing a door for a refrigerator of the present invention.

Referring FIG. 1 to FIG. 3, a door 50 for a refrigerator comprises an outer door 51 forming the exterior and a cap decoration 53, 57 formed at the upper part and the lower part of the outer door 51.

The outer door 51 is composed of a front board 51*a* forming the front exterior of the door 50 and a lateral board 51*b* forming the lateral exterior of the door 50.

The front board 51*a* is a rectangle, and the lateral board 51*b* is formed with the both ends of the front board 51*a* bent backward to be crossed at the right angles on the rear surface of the front board 51*a*.

The cap decoration 53, 57 form the exterior of the upper part or the lower part of the outer door 51. The cap decoration 53, 57 form the inside of the door for a refrigerator as formed to contact with the front board 51*a* and lateral board 51*b* of the outer door 51.

As illustrated in FIG. 2, a fixing bracket 54 is arranged at the lower part of the cap decoration 53. It is possible for the fixing bracket 54 to have a cross section of the shape of C as protruded from the lower part of the cap decoration 53.

Further, a supporting part 56 is arranged at the end of the lower part of the cap decoration 53 adjacent to the fixing bracket 54. The supporting part 56 is located as adjacent with a predetermined distance to the direction of the opening of the fixing bracket 54. A hinge receiving unit 55 arranged at a side of the supporting part 56 and on which the hinge (not illustrated) rotating letting the door rotated from the refrigerator reaches.

Furthermore, a multitude of contact protrusions 56*a* is arranged at the supporting part 56. The contact protrusions 56*a* are adjacent to each other with predetermined intervals and formed as long upward and downward.

The contact protrusion 56*a* is protruded from the lower part that is the bottom of the hinge receiving unit 55 to the upper part.

Further, a hinge opening 57*a* is arranged at an end of the cap decoration 57 forming the exterior of the lower part of the door 50. The hinge opening 57*a* is formed as a part of the cap decoration 57 is incised.

An incision unit on which a dispenser housing 59 is installed is formed at the front board 51*a*. A predetermined installation space, in which a dispenser for taking water or ice out is installed, is formed at the dispenser housing 59.

A water tank 61 is formed in the door 50. The water tank stores water served out through the dispenser. The water tank 61 is formed in the shape of L and a part of it 61 is stuck to the back of the dispenser housing 59.

Further, an ice guide outlet 63 is arranged in the door 50. The ice guide outlet 63 is to lead the ice made in the ice machine that will be described on the following to the dispenser. The ice guide outlet 63 is formed in the shape of a hopper that the front is opened, and leads ice to the dispenser through the upper part of the dispenser housing 59.

The water tank 61 is connected with an end of a first water pipe 65. The first water pipe 65 is drawn into the door 50 through the hinge opening 57*a* of the cap decoration 57. Furthermore, a water valve (not illustrated) is arranged at the other end of the first water pipe 65 to supply water optionally.

A second water pipe 67 is drawn into the door through the hinge opening of the cap decoration 57. The second water pipe 67 is for providing water to the ice machine. An end of the second water pipe 67 is drawn into the door 50 through the hinge opening 57*a* of the cap decoration 57. A water valve (not illustrated) is arranged at the other end of the second water pipe 67 as the first water pipe 65.

On the other hand, a fixing member 70 is arranged in the door 50. The fixing member 70 is for fixing the second water pipe 67 drawn into the door 50. The fixing member 70 is fixed as connected with the fixing bracket 54 and the supporting part 56 of the cap decoration 53, and a part of it contacts a back part of the front board 51*a* of the outer door 51.

For this, a fixing protrusion 71 is arranged at a side of the fixing member 70. The fixing protrusion 71 contacts each of the inside of the fixing bracket 54 and the supporting part 56. That is, the fixing protrusion 71 is fixed as inserted into the space formed by the fixing bracket 54 and the supporting part 56.

As illustrated in detail in FIG. 3, a receiving groove 73 is arranged at a part of the fixing member 70 contacting a part of the back of the front board 51*a* of the outer door 51. The receiving groove 73 is formed as long upward and downward as a part of the fixing member 70 is depressed into its inside.

The second water pipe 67 is fixed at the receiving groove 73 as the second water pipe 67 reaches the receiving groove 73.

An opening 74 is formed at the other side of the fixing member 70 that is the opposite side of a part of the fixing member 70 contacting a back part of the front board 51*a* of the outer door 51. The opening 74 is connected with the receiving groove 73. Therefore, the second water pipe 67 received the receiving groove 73 is drawn out through the opening 74.

A multitude of moving slots 75 is arranged at a part of the fixing member 70 contacting a back part of the front board 51*a* of the outer door 51, that is, at a side pf the fixing member 70 on which the receiving groove 73 is formed. The moving slot 75 is formed as long upward and downward as a part of the fixing member is depressed into its inside as the receiving groove 73. The moving slots 75 are passages through which the foaming liquid fed into the door 50 flows. That is, the foaming liquid fed into the door 50 flows through the space between the back of the front board 51*a* of the outer door 51 and the moving slot 75.

A multitude of supporting ribs 77 are arranged at a side of the fixing member 70 on which the receiving groove 73 and the moving slot 75 are formed. The supporting ribs 77 contact the back of the front board 51*a* of the outer door 51 at the state that the fixing member 70 is fixed at the cap decoration 53. The supporting rib 77 is arranged by turns with the receiving groove 73 that a part of the fixing member 70 is depressed into its inside and the moving slot 75.

Further, a contact rib 79 is arranged at a side of the fixing member 70. The contact rib 79 contacts the back of the lateral board 51*b* of the outer door 51 at the state that the fixing protrusion 71 is forcibly inserted into the space formed by the fixing bracket 54 and the supporting part 56.

On the other hand, a door liner (not illustrated) is arranged at the rear of the outer door 51. The door liner 50 forms the rear exterior of the door 50. An ice machine (not illustrated) is installed at the rear of the door, that is, at a side of the door liner. The ice machine makes ice served to outside through the dispenser.

An opening (not illustrated) is formed at a side of the door liner. The opening of the door liner is formed at the location corresponding to the opening 74 of the fixing member 70. Therefore, an end of the second water pipe 67 fixed as reached the receiving groove 73 as drawn into the door 50 through the hinge opening 57*a* of the cap decoration 57 is connected to the ice machine as drawn out of the door after passing the opening 74 of the fixing member 70 and the opening of the door liner in order. Further, the foaming liquid to form an insulation layer is fed into the space formed by the outer door 51, the cap decoration 53, 57 and the door liner, that is into the door 50. The current of the foaming liquid fed into the door 50 is not disturbed with the fixing member 70 as flown through the moving slot 75.

Reference will now be made in detail as for the manufacturing process of the advisable preferred embodiment of a door for a refrigerator according to the present invention configured as above.

As illustrated in FIG. 1, the outer door 51, the cap decoration 53, 57, the dispenser housing 59, the water tank 61 and the ice guide outlet 63 are assembled for the first of all. The first and the second water pipes 65, 67 are drawn into the space formed by the inside of the door 50, that is, the outer door 51 and the cap decoration 53, 57 through the hinge opening 57*a* of the cap decoration 57. Further, an end of the first water pipe 65 drawn into the door 50 is connected to the water tank 61.

For the next, the second water pipe 67 drawn into the door 50 is reached the receiving groove 73. Then, end of the second water pipe 67 reached the receiving groove 73 is drawn out through the opening 74 of the fixing member 70 with as much as a predetermined length.

A part of the fixing member 70 having a receiving groove 73 and a moving slot 75 contacts the back of the front board 51*a* of the outer door 51. Therefore, the supporting rib 77 arranged by turns with the receiving groove 73 and the moving slot 75 contacts the back of the front board 51*a* of the outer door 51. The fixing member 70 is fixed as moving the fixing protrusion 71 to be forcibly inserted into the space between the fixing bracket 54 and the supporting part 56. Here, the contact rib 79 of the fixing member 70 contacts the back of the lateral board 51*b* of the outer door 51.

When the fixing member 70 is fixed at the cap decoration 53, the foaming liquid if fed into the door 50. The foaming liquid fed into the door 50 flows through the moving slot or the space between the moving slot 75 and the back of the front board 51*a* of the outer door 51.

Further, the door liner is coupled with the back end of the outer door 51 and the cap decoration 53, 57. Here, the second water pipe 67 drawn out through the opening 74 of the fixing member 70 is drawn out of the door 50 through the opening of the door liner. When the insulation layer is formed as the foaming liquid fed into the door 50 is hardened, the manufacturing of the door is completed.

It is possible for the present invention to be changed in many ways in the scope of the basic technical idea of the present invention by anyone who has regular knowledge in the present industry, and the scope of the rights of the present invention has to be analyzed as drafting the accompanying claims.

According to a door for a refrigerator according to the present invention, the foaming liquid is fed into the door evenly.

Further, according to a door for a refrigerator according to the present invention, the surface of the door is not dewed.

What is claimed is:

1. A door for a refrigerator, comprising:

an outer door forming the front exterior;

a cap decoration formed at the upper and lower sides of the outer door;

a water pipe drawn into the door through the cap decoration and through which water flows;

a fixing member provided with a first groove fixing the water pipe and a second groove forming a passage, the second groove being spaced from the first groove; and a plurality of supporting ribs configured to support the fixing member with the outer door, the supporting ribs adapted to protrude from the fixing member to contact the outer door, and the supporting ribs including a first rib, a second rib and a third rib arranged adjacent to each other, and wherein the first groove is defined as a space between the first rib and the second rib, and the second groove is defined as a space between the second rib and the third rib.

2. The door for a refrigerator according to claim 1, wherein the supporting ribs contact a back of the outer door to be arranged at the fixing member.

3. The door for a refrigerator according to claim 1, wherein the second groove and the supporting ribs are alternately formed in the fixing member.

4. The door for a refrigerator according to claim 1, wherein a side of the fixing member is snapped-on with a supporting part formed at the lower part of the cap decoration.

5. The door for a refrigerator according to claim 4, wherein the supporting part is composed of a fixing bracket formed in a C-shape and a supporting surface arranged at a distance in relation to the fixing bracket.

6. The door for a refrigerator according to claim 1, wherein the outer door includes a lateral board forming the lateral exterior, and a side of the fixing member includes a contact rib contacting the lateral board.

7. The door for a refrigerator according to claim 1, wherein an opening through which the water pipe is drawn out is formed at the fixing member.

8. A door for a refrigerator, comprising:

an outer door forming the front exterior;

an ice machine making ice as located at the rear of the outer door;

a water pipe supplying water into the ice machine from the rear of the outer door;

a fixing member inserted into the outer door, the fixing member including an opening configured to draw the water pipe out therethrough;

a fixed area between the outer door and the fixing member, the fixed area including a first section fixing the location of the water pipe and a second section through which foaming liquid flows, wherein the second section is separated from the first section; and at least one supporting rib partitioning the fixed area into the first section and the second section, the supporting ribs having a plurality of ribs arranged side by side, wherein the first section is defined by a first closed space formed between two ribs and the outer door, and the second section is defined by a second closed space formed between two ribs and the outer door.

9. The door for a refrigerator according to claim 8, wherein the supporting ribs contact the rear of the outer door.

10. The door for a refrigerator according to claim 8, wherein the fixing member is fixed as inserted into a supporting part arranged at the bottom of a cap decoration forming the top exterior.

11. The door for a refrigerator according to claim 10, wherein the supporting part is composed of a fixing bracket formed in a C-shape and a supporting surface arranged at a distance in relation to the fixing bracket.

12. The door for a refrigerator according to claim 8, wherein the outer door includes a lateral board forming the lateral exterior, and a side of the fixing member includes a contact rib contacting the lateral board.

13. A door for a refrigerator, comprising:

an outer door forming the front exterior;

a water pipe drawn into the door and through which water flows;

a fixing member provided with a first groove fixing the water pipe, the first groove not extending through the fixing member, and a second groove forming a passage, the second groove being spaced from the first groove, the second groove not passing through the fixing member, and a supporting rib configured to support the fixing member with the outer door, wherein the supporting rib separates the first groove from the second groove.

14. The door for a refrigerator according to claim 13, further comprising an opening extending to the first groove and configured to draw the water pipe out therethrough.

* * * * *